US009091031B2

(12) United States Patent
Naseem

(10) Patent No.: US 9,091,031 B2
(45) Date of Patent: Jul. 28, 2015

(54) PICK AND PACK SCOOPER

(71) Applicant: Arshad Naseem, Windsor (CA)

(72) Inventor: Arshad Naseem, Windsor (CA)

( * ) Notice: Subject to any disclaimer, the term of this patent is extended or adjusted under 35 U.S.C. 154(b) by 0 days.

(21) Appl. No.: 14/104,231

(22) Filed: Dec. 12, 2013

(65) Prior Publication Data

US 2015/0167264 A1 Jun. 18, 2015

(51) Int. Cl.
*A01K 29/00* (2006.01)
*E01H 1/12* (2006.01)

(52) U.S. Cl.
CPC ..... *E01H 1/1206* (2013.01); *E01H 2001/122* (2013.01)

(58) Field of Classification Search
USPC ..... 294/1.3–15, 4.4, 1.5, 50.8, 179; 15/257.6; 119/161, 165
See application file for complete search history.

(56) References Cited

U.S. PATENT DOCUMENTS

| | | | | | |
|---|---|---|---|---|---|
| 3,617,084 | A * | 11/1971 | Mares | 294/1.4 |
| 3,912,316 | A * | 10/1975 | Veech | 294/1.4 |
| 4,010,970 | A * | 3/1977 | Campbell | 294/1.5 |
| 4,247,139 | A * | 1/1981 | Grieb | 294/1.4 |
| 4,248,468 | A * | 2/1981 | Hastings | 294/1.4 |
| 4,477,111 | A * | 10/1984 | Crooks | 294/1.4 |
| 7,178,843 | B2 * | 2/2007 | Askinasi | 294/1.4 |
| 2004/0004361 | A1 * | 1/2004 | Foster et al. | 294/1.4 |
| 2007/0194580 | A1 * | 8/2007 | Raasch | 294/1.4 |
| 2008/0265592 | A1 * | 10/2008 | Askinasi | 294/1.4 |

* cited by examiner

*Primary Examiner* — Paul T Chin

(57) ABSTRACT

A pet waste disposal device has a handle, a body, and a waste handling portion with two opposing scoops, which pivot outwardly between an open position and a closed position. A heating block and a pressing block extend along the free edges of the opposing scoops. Current from a power source, operable at the handle, runs through a heating wire on the heating block to seal pet waste within a plastic bag pressed between the contact faces of the heating block and pressing block.

2 Claims, 6 Drawing Sheets

PICK AND PACK SCOOPER

FIELD OF THE INVENTION

The invention relates to pet waste disposal devices, in particular, to a pet waste disposal device that seals pet waste within a plastic bag.

BACKGROUND

A known method for disposing of pet waste is to place a plastic bag over one hand, manually pick up the waste, tie the bag, and dispose of the waste in a nearby receptacle, such as a garbage bin. Other varieties of pet waste removal devices are available to assist in the disposal of pet waste, but these devices still require a user to transfer the waste from the device into a bag and manually tie the bag.

Accordingly, there is a need for a device that eliminates the need for a user to manually handle pet waste, or the bag containing it, prior to disposal in a nearby receptacle.

SUMMARY OF THE INVENTION

The pet waste disposal device, according to the present invention, has a handle, a body, and a waste handling portion with two opposing scoops pivotally mounted to the body. A heating block and a pressing block extend along an edge within the opposing scoops, such that they abut one another when the scoops are closed.

BRIEF DESCRIPTION OF THE DRAWINGS

In order that the invention may be more clearly understood, a preferred embodiment thereof will now be described by way of example, with reference to the accompanying drawings, in which.

DESCRIPTION OF THE INVENTION

The pet waste disposal device, according to the present invention, collects pet waste in a plastic bag and seals the bag for sanitary disposal.

Figure 1:
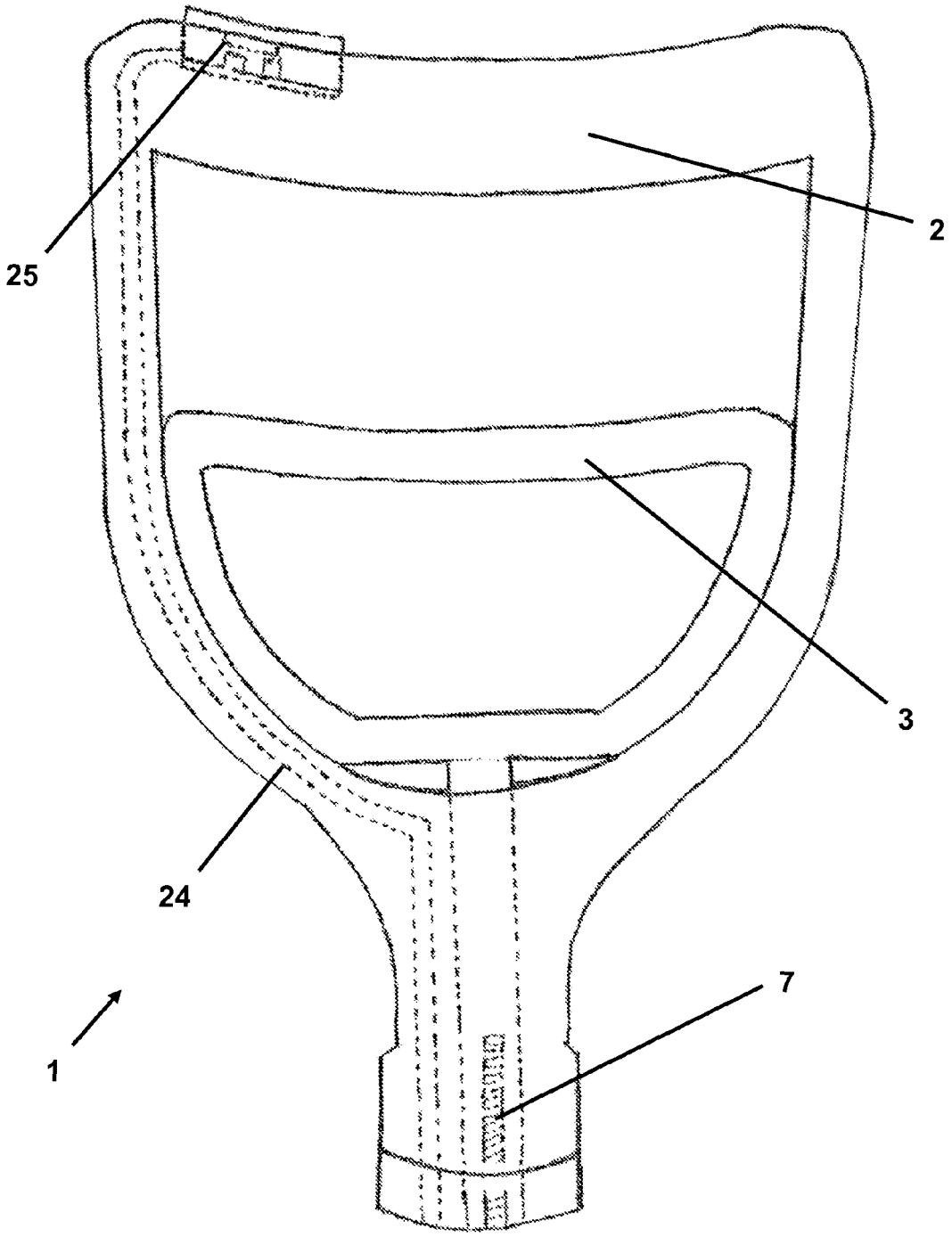
FIG. 1 is a front view of the handle.

As shown in FIG. 1, the handle 1 has a grip 2 and a mechanical control mechanism, such as an actuating lever 3. The grip 2 is, preferably, a horizontal bar that has downward extensions from both ends that curve towards one another to give the handle 1 a closed U-shape. The actuating lever 3 is shaped to fit within interior of the U-shaped handle 1. Preferably, it has a similar closed U-shape. This configuration permits a user to actuate the actuating lever 3 with one or more fingers of the hand holding the grip 2.

Figure 2:
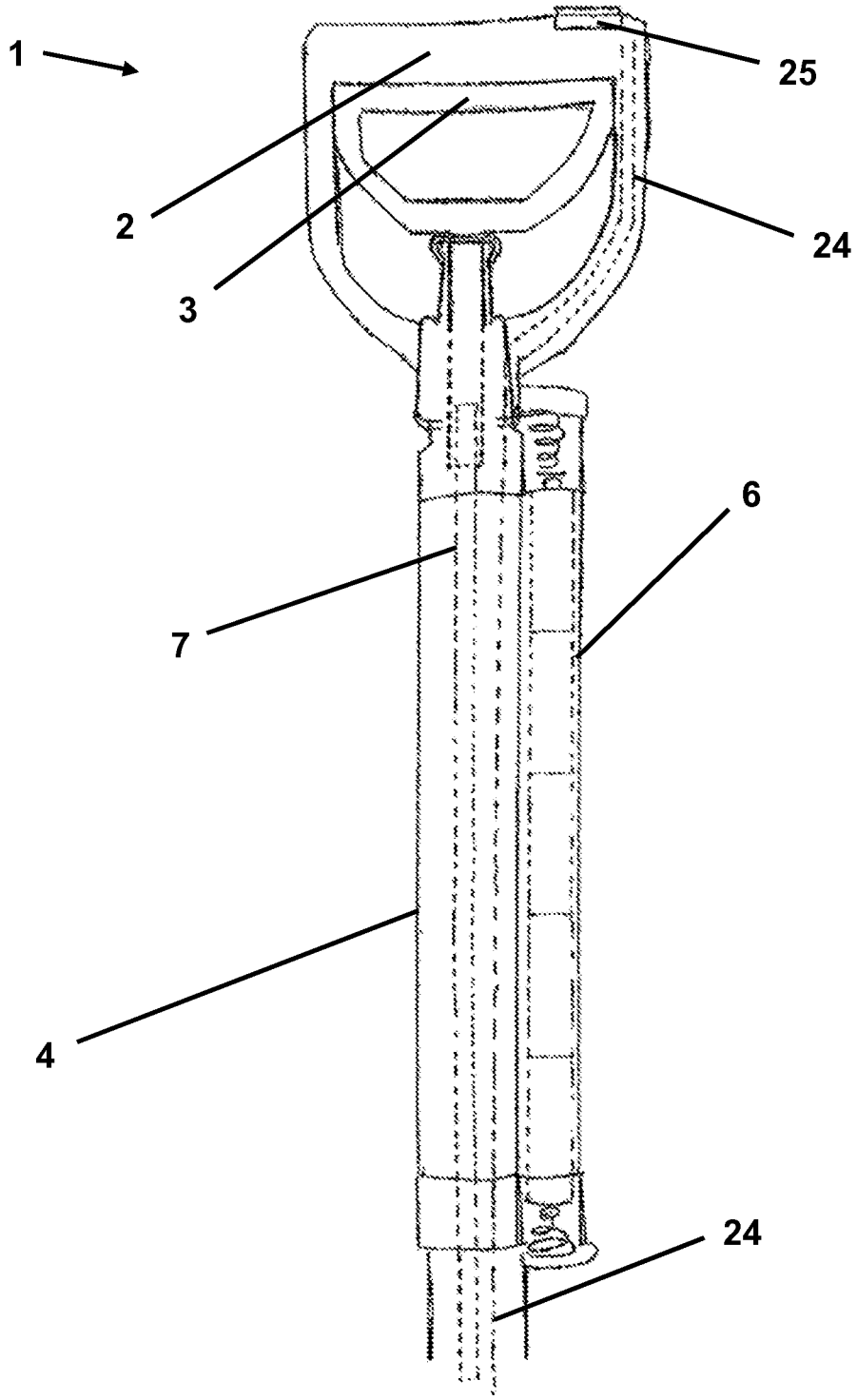
FIG. 2 is front view of the handle and body.
Figure 3:
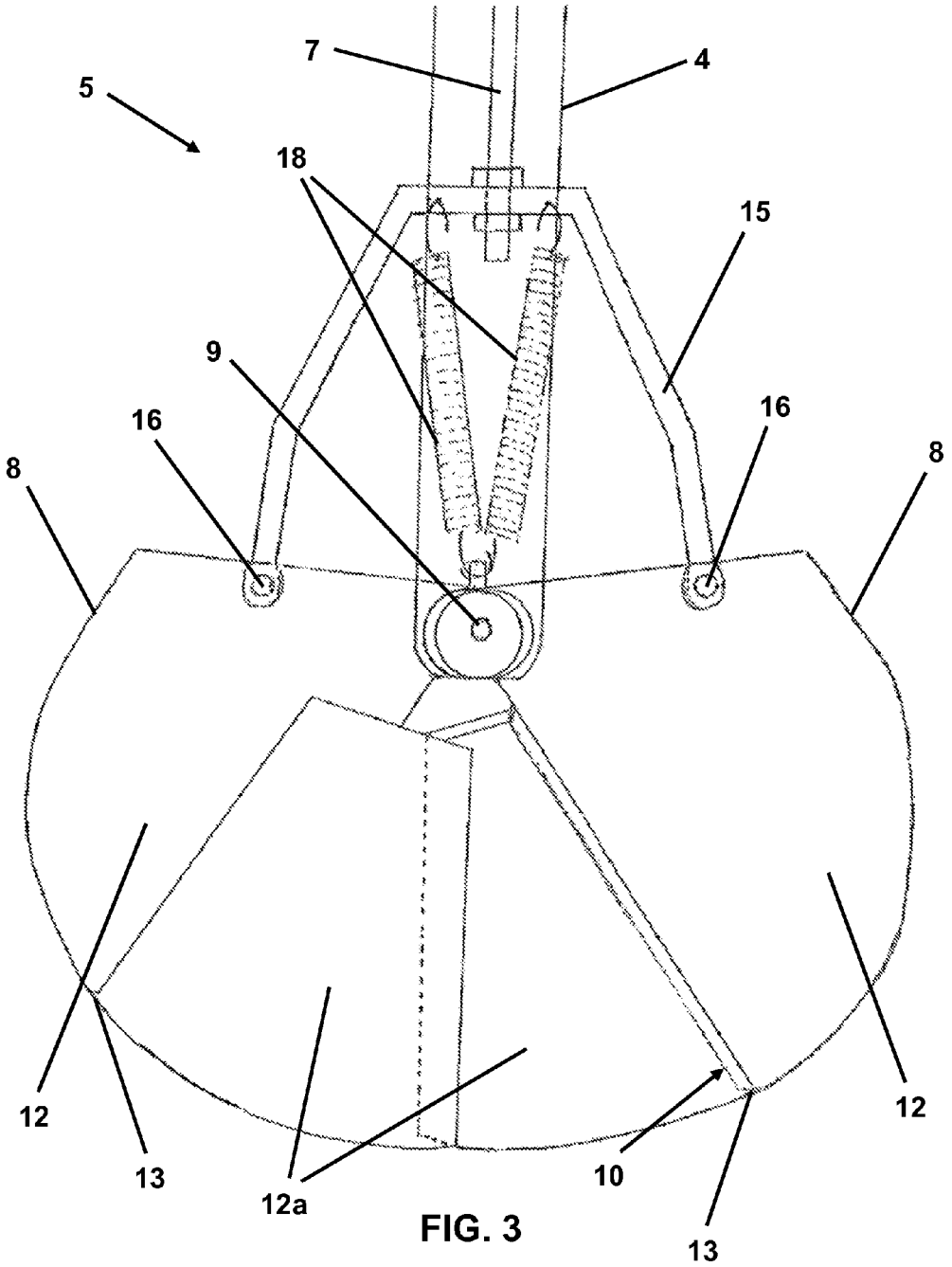
FIG. 3 is a side view of the waste handling portion in the open position.

As shown in FIG. 2, the handle 1 is attached to a body 4. Preferably, the body 4 is a hollow cylinder that is attached at its upper end to the handle 1 and at its lower end to the waste handling portion 5, as shown in FIG. 3. A power source 6 is located on the body 4. Preferably, the power source 6 is a battery pack, such as, for example, five AA batteries.

The actuating lever 3 on the handle 1 is operatively engaged with the waste handling portion 5, preferably, by way of a shaft 7, which runs through the hollow centre of the body 4.

Figure 7:
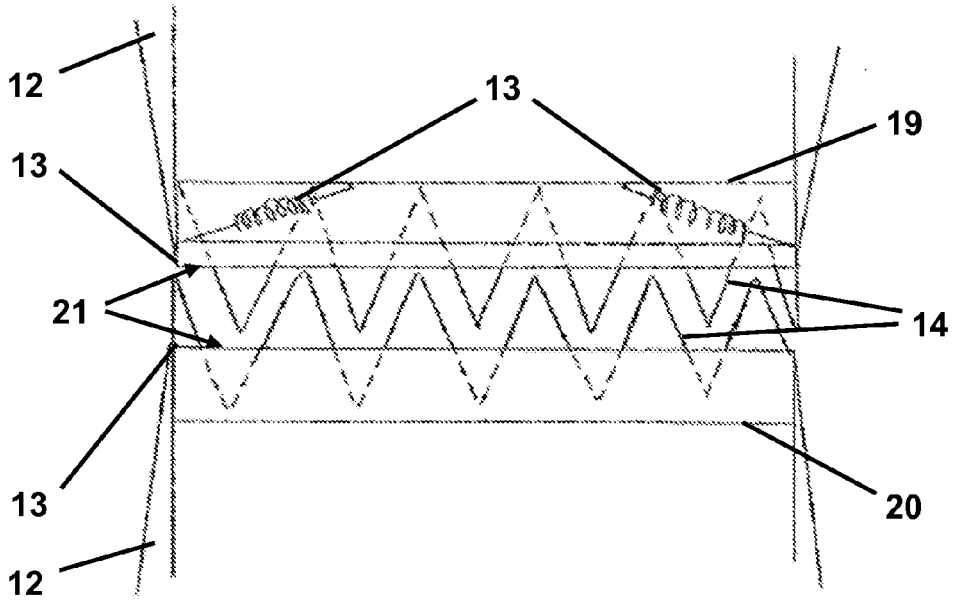
FIG. 7 is an interior view of the waste handling portion, showing the bag sealer elements.
Figure 8:
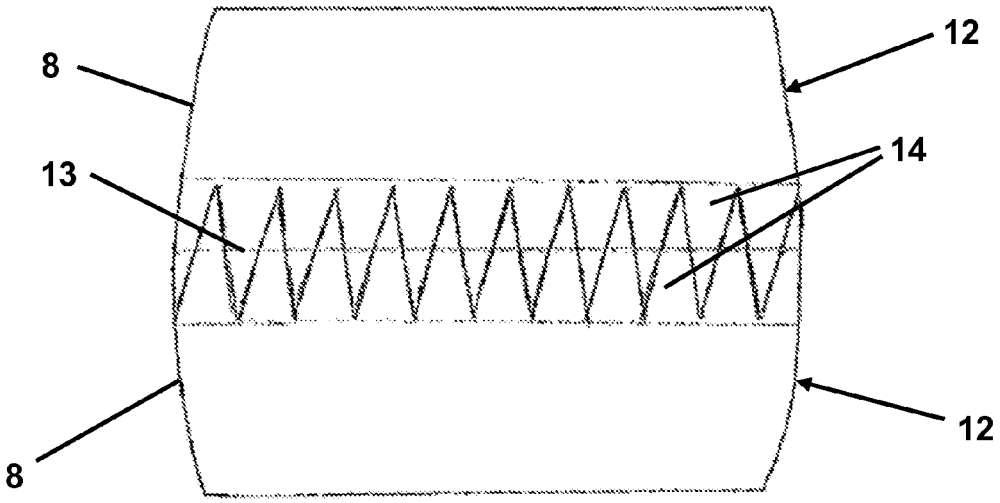
FIG. 8 is a bottom view of the waste handling portion in the closed position.

As shown in FIG. 3, the body 4 is attached to the waste handling portion 5. The waste handling portion 5 has two opposing scoops 8, which are pivotally mounted on a pivot pin 9 attached at the lower end of the body 4. Each scoop 8 has an open, hollow, generally semi-cylindrical shape with an open side 10, a curved side 11, and two opposing end walls 12. The hollow interior of the scoop 8 is open to the open side 10. The open side 10 of the scoop 8 is opposite the curved side 11, to permit the scoop 8 to retain waste within the hollow space between the opposing end walls 12. The scoops 8 are arranged like opposing claws, preferably, attached at the pivot pin 9 near the edge where the open side 10 meets the curved side 11, such that the two open sides 10 face one another. As shown in FIGS. 7 and 8, the free edge 13 of the curved side 11 opposite this corner may be provided with teeth 14.

As shown in FIG. 3, an inverted U-shaped element 15 is pivotally attached at either end to the two scoops 8, by way of connecting pins 16. The connecting pins 16 are located on the curved side 11 of the scoops 8, spaced apart from the pivot pin 9. The shaft 7 is attached to the top of the inverted U-shaped element 15 permitting a user to raise and lower the inverted U-shaped element 15 by actuating the actuating lever 3. Because the pivot pin 9 is attached to the body 4 and does not move with the shaft 7, actuation of the actuating lever 3 pivots the scoops 8 about the pivot pin 9.

Figure 4:
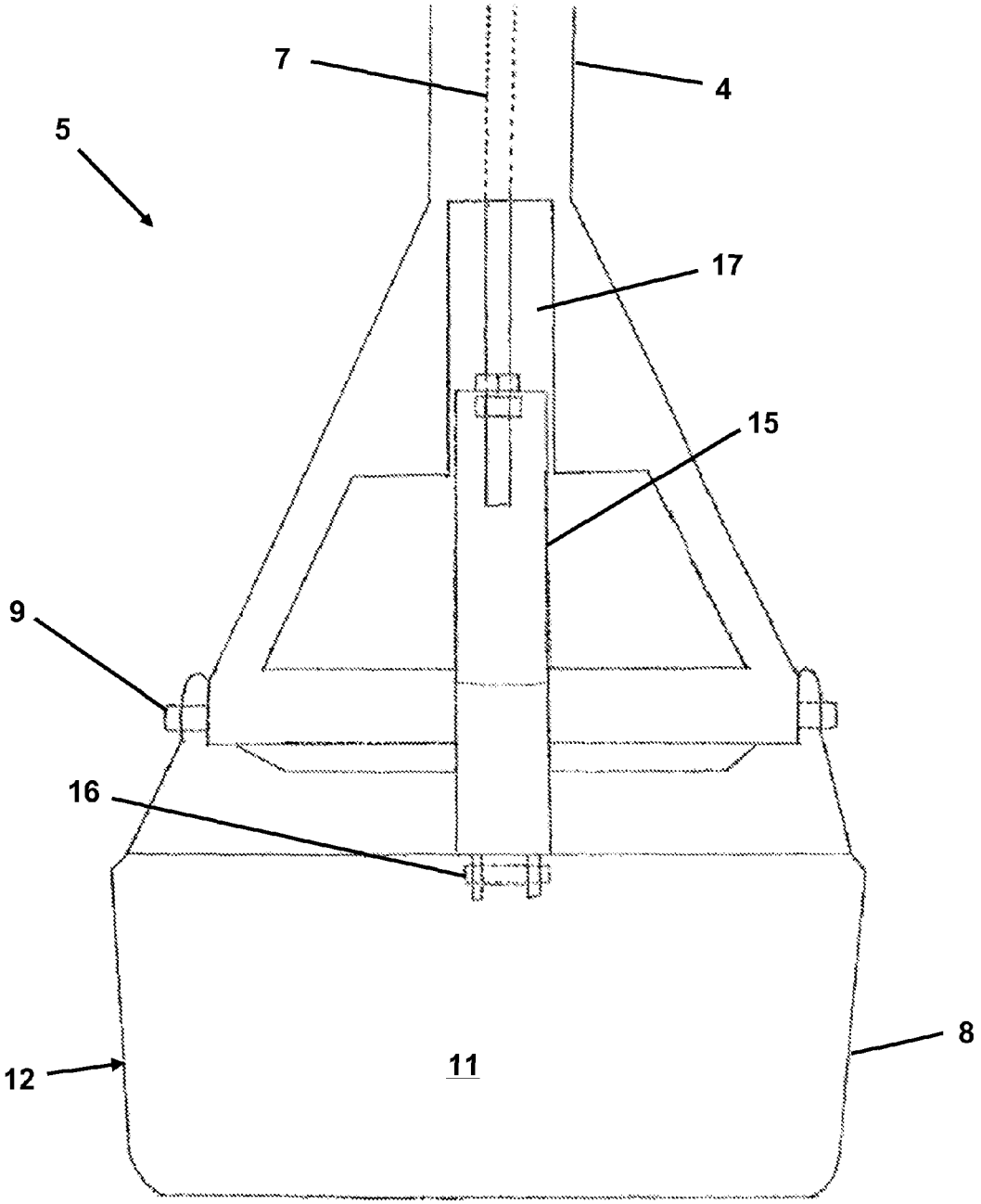
FIG. 4 is a front view of the waste handling portion.

As shown in FIG. 4, the lower end of the body 4 flares outwardly toward the end walls 12 of the scoops 8 and has a cutaway 17 to expose the lower end of the shaft 7 on both sides. The inverted U-shaped element 15 extends outwardly from the shaft 7, through the cutaway 17. The cutaway 17 has a width greater than the width of the inverted U-shaped element 15 and a sufficient length to permit the inverted U-shaped element to travel upwardly and downwardly therein in response to actuation of the actuating lever 3.

A biasing mechanism, such as springs 18, shown in FIG. 3, maintains the opposing scoops 8 in a closed position, with the two free edges 13 in abutment. The scoops 8 are pivoted outwardly, to an open position, with the free edges 13 spaced apart from one another, by actuating the actuating lever 3. A locking mechanism may be provided to selectively lock the scoops 8 in the open position. Preferably, the locking mechanism is located on the handle 1, to permit a user to operate the locking mechanism with the hand holding the grip 2.

With the scoops 8 in the open position, the closed end of a plastic bag is placed within the space between the scoops 8 with the open end protruding from between the free edges 13. The open end of the plastic bag is folded over the outside of the scoops 8. To retain the open end of the plastic bag in place around the outside of the scoops 8 an adhesive strip (not shown) may be provided on the outside surface of the scoops 8 and the plastic bag may be removably attached thereto. In order to retain the bag within the space between the opposing scoops 8 while in the open position, end wall extensions **12*a* may be provided on the end walls 12. The end wall extensions 12*a* extend outwardly parallel to the end walls 12 and are offset to the side the end wall extensions 12*a* of the opposing scoop 8 so as to slide past one another as the scoops 8** are pivoted between the open and closed positions.

Figure 5:
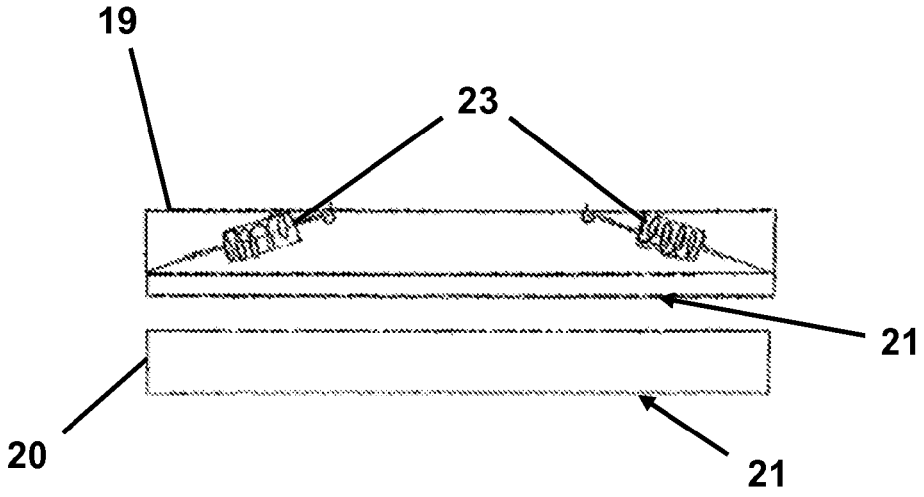
FIG. 5 is a top view of the bag sealer elements.
Figure 6:
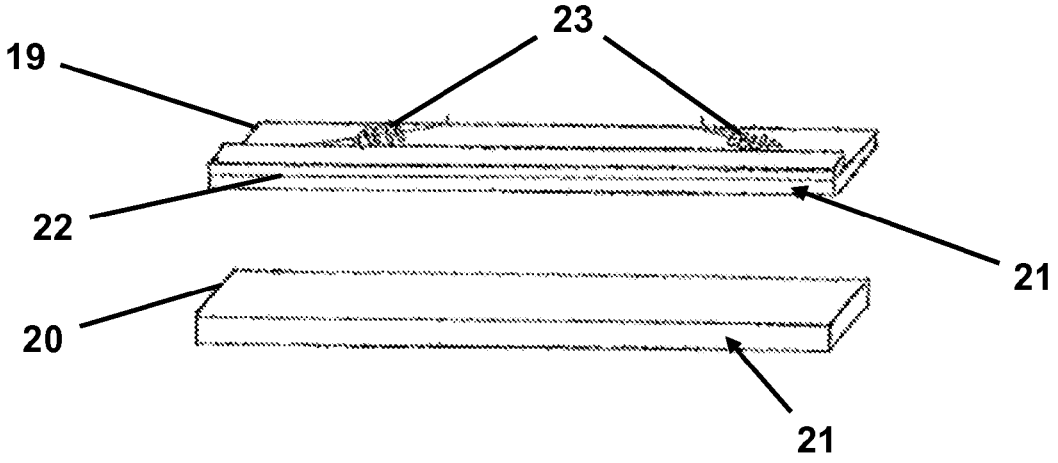
FIG. 6 is a perspective view of the bag sealer elements.

In order to seal the bag, the free edge 13 of one of the scoops 8 is provided with a heating block 19 and the free edge 13 of the opposing scoop 8 is provided with a pressing block 20, as shown in FIG. 7. As shown in FIGS. 5 and 6, the heating block 19 and pressing block 20 are generally rectangular and extend along the full length of the free edges 13 of the scoops 8. The heating block 19 and pressing block 20 are positioned adjacent the free edge 13 on the interior of the scoop 8, so that the opposing contact faces 21 of the heating block 19 and pressing block 20 abut against one another when the scoops 8 are in the closed position. Preferably, the heating block 19 and the pressing block 20 are made of a hard plastic and the contact face 21 of the pressing block 20 is covered by a rubber strip to improve the seal between the opposing contact faces 21.

As shown in FIG. 6, a heating wire 22 extends along the contact face 21 of the heating block 19. The heating wire 22 generates heat in response to an electrical current. Preferably, the tension of the heating wire 22 is maintained by tension springs 23, as it expands and contracts under heating and cooling. The heating wire 22 is connected to the power source 6, by wiring 24 that travels through the hollow interior of the body 4 and the handle 1 to an electronic control mechanism, such as a momentary pushbutton switch 25, located on the handle 1. This allows the user to operate the pushbutton switch 25 to activate the heating wire 22 with the hand holding the grip 2.

Pet waste may be disposed, using the pet waste disposal device, according to the present invention, by installing a plastic bag within the space between the scoops 8, as described above. The user then grasps the grip 2, positions the device above the pet waste, and actuates the actuating lever 3 to pivot the scoops 8 to the open position. The user then lowers the scoops 8 over the pet waste and releases the actuating lever 3, permitting the scoops 8 to pivot to the closed position with the pet waste contained within the plastic bag inside the scoops 8. The user then presses the momentary pushbutton switch 25, thereby activating the heating wire 22 and temporarily melting the plastic pressed between the opposing contact faces 21 of the heating block 19 and pressing block 20. The user then releases the momentary pushbutton switch 25 de-activating the heating wire 22 and allowing the plastic to cool, thereby sealing the pet waste within the plastic bag inside the scoops 8. The scoops 8 will remain in the closed position until the user again actuates the actuating lever 3 to deposit the sealed bag in a convenient receptacle, such as a nearby garbage bin. The sealed bag will drop out of the space between the scoops 8 without any manual manipulation by the user, because of the weight of the pet waste therein.

What is claimed is:

1. A pet waste disposal device, to be used in combination with a heat sealable plastic bag having an open and a closed end, the device comprising:

a handle having a grip and actuating lever, wherein the handle is connected to a hollow body having an upper end, a lower end, a power source, a shaft operably engaged with the actuating lever and running through the hollow body, and a waste handling portion connected to the hollow body having first and second opposing scoops each having an open side, the open side having first and second opposing edges, wherein the scoops are pivotally mounted to the lower end of the hollow body at the first edge such that the open sides face one another and operably engaged with the shaft to permit the scoops to pivot between a closed position with the second edges abutting one another and an open position with the second edges spaced apart, a heating block extending along the second edge of the first scoop and electrically connected to the power source, and a pressing block extending along the second edge of the second scoop, wherein the heating block and pressing block are positioned so as to abut against one another when the scoops are in the closed position, and a power control mechanism that selectively controls the supply of power from the power source to the heating block.

2. The pet waste disposal device of claim 1, wherein the first and second opposing scoops each have opposing end walls with end wall extensions extending outwardly parallel to the end walls and wherein the end wall extensions of the second scoop are offset to the side from the end wall extensions of the first scoop.

* * * * *